US006890037B2

(12) United States Patent
Stewart

(10) Patent No.: US 6,890,037 B2
(45) Date of Patent: May 10, 2005

(54) CUTTING DRUM WEB DEFLECTOR

(75) Inventor: Christopher G Stewart, Oil City, PA (US)

(73) Assignee: Joy M M Delaware, Inc., Wilmington, DE (US)

( * ) Notice: Subject to any disclaimer, the term of this patent is extended or adjusted under 35 U.S.C. 154(b) by 0 days.

(21) Appl. No.: 10/371,866

(22) Filed: Feb. 21, 2003

(65) Prior Publication Data

US 2004/0164603 A1 Aug. 26, 2004

(51) Int. Cl.[7] ..... E21C 25/10
(52) U.S. Cl. ..... 299/79.1; 299/39.4; 299/78
(58) Field of Search ..... 299/39.4, 39.6, 299/78, 76, 73, 80.1, 79.1

(56) References Cited

U.S. PATENT DOCUMENTS 2,808,253 A * 10/1957 Miller ..... 299/76
3,318,638 A * 5/1967 Kilbourne ..... 299/76
3,617,093 A * 11/1971 Daily ..... 299/80.1
3,773,384 A * 11/1973 Anderson ..... 299/76
3,774,969 A * 11/1973 Lebegue ..... 299/76
4,047,763 A * 9/1977 Gilliland et al. ..... 299/76
4,277,105 A * 7/1981 Taylor ..... 299/64
5,964,507 A * 10/1999 Blackstock et al. ..... 299/76
6,224,164 B1 * 5/2001 Hall et al. ..... 299/75

* cited by examiner

*Primary Examiner*—David Bagnell
*Assistant Examiner*—Daniel P Stephenson
(74) *Attorney, Agent, or Firm*—James Earl Lowe, Jr.

(57) ABSTRACT

A cutting device including a cutting drum, a motor housing, a structural web extending between the motor housing and the cutting drum, and a structural member attached to the cutting drum adjacent the web. The structural member has a structural surface including an edge adjacent the web and an edge away from the web. The surface has an edge away from the web, the surface being inclined away from the web by having the edge adjacent the web forward in the cutting direction of the edge away from the web. In the preferred embodiment, the structural member is a bit mechanism including a bit, and the structural member houses the bit.

2 Claims, 2 Drawing Sheets

CUTTING DRUM WEB DEFLECTOR

BACKGROUND OF THE INVENTION

The present invention relates to material removing tools in general, and, more particularly, to improvements in rotary cutters. Still more particularly, the invention relates to rotary cutters of the type wherein a rotor is driven by a shaft and carries a plurality of external material removing bits.

Continuous miners by their nature utilize a series of rotating drums with cutter bits placed at very specific positions in order to accommodate a number of different cutting situations. There are two basic types of cutting drums. The ripper chain, which includes a central ripper chain between two rotating drums, and the solid head, which does not have a central ripper chain between the rotating drums.

The main advantage of the ripper chain is that when it cuts, it leaves no coring or gap in cutting profile between the rotating drums. This is because the power transmission webs for transferring power from a motor to the ripper chain and rotating drums is underneath the chain itself. The solid head doesn't have the ability to cover up the power transmission webs like a ripper chain does, so the area between the rotating drums must be left open for the power transmission webs. Because of this space left between the drums for the webs, that area can't be cut out by a cutting tool.

If the webs are too wide, the remaining uncut material will not break off naturally and can keep the machine from penetrating into the face of the material it's trying to cut. If the web is too narrow, then the webs don't have sufficient strength to support the drums and withstand the extreme forces the cutting head is subjected to. An optimum design is a web that's narrow enough to have the material core break off by itself and wide enough to withstand the cutting and fatigue loads it sees.

As shown in FIG. 1, as material is cut away from the face by the cutting tools 12, much of it is recirculated around the cutting drum 10. As this material is passed around the drum 10, the bit and the bit holders fracture and redirect the broken material to either side of the bit holder 12. This direction of material back to a structural web 16 causes impact and regrinding of the material against the web. This impacting of the material against the web erodes away the web steel regardless of its hardness and abrasion resistance. In even some instances, rock pieces can be wedged in between the bit holder 12 and the web 16 and cause catastrophic damage to any exposed components.

When possible, exposed tubes have been used to semi-protect the drive through shaft in the web from this type of damage. This isn't always possible, however, and warranty costs are incurred as a result. At the very least, the long term erosion that takes place causes a reduction in web strength. Expensive rework must be done periodically in order to get additional life from the rotating drums. As miner duty cycles increase, the web steel id less likely to make it through the complete rebuild cycle.

SUMMARY OF THE INVENTION

One of the objects of the invention is to utilize the cutting bits, bit sleeves, bit holders and bit pedestals to redirect the cut material away from the gear case structural webs as the material passes in close proximity to the webs.

This invention provides a cutting drum, a motor housing, a structural web extending between the motor housing and the cutting drum, and a redirection face that deflects material away from the web. The redirection face acts much like a "cowcatcher" or "scraper" type of device and directs away from the web the majority of abrasive material that can damage or erode the web. More particularly, the redirection face is a structural member attached to the cutting drum adjacent the web, the structural member having a structural surface including an edge adjacent the web and an edge away from the web, the surface being inclined away from the web by having the edge adjacent the web forward in the cutting direction of the edge away from the web. Still more particularly, the structural member can be a bit mechanism including a bit, and the structural member can house the bit.

Figure 1:
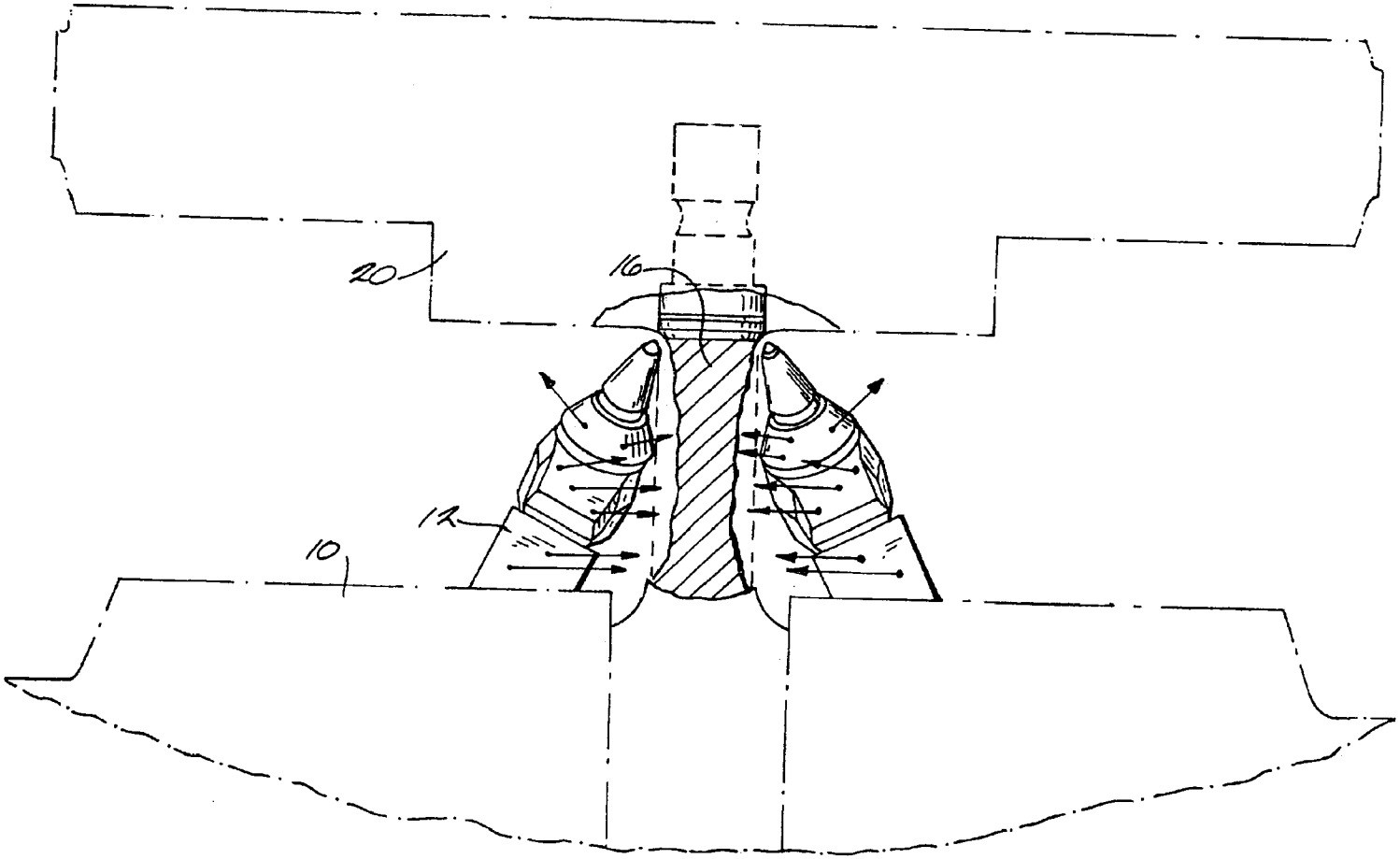
Fig. 1 PRIOR ART
FIG. 1 is a top view of a prior art cutting device including a cutting drum, a motor housing, a structural web extending between the motor housing and the cutting drum, and a structural member housing a bit and attached to the cutting drum adjacent the web.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

DESCRIPTION OF THE PREFERRED EMBODIMENT OF THE INVENTION

Figure 2:
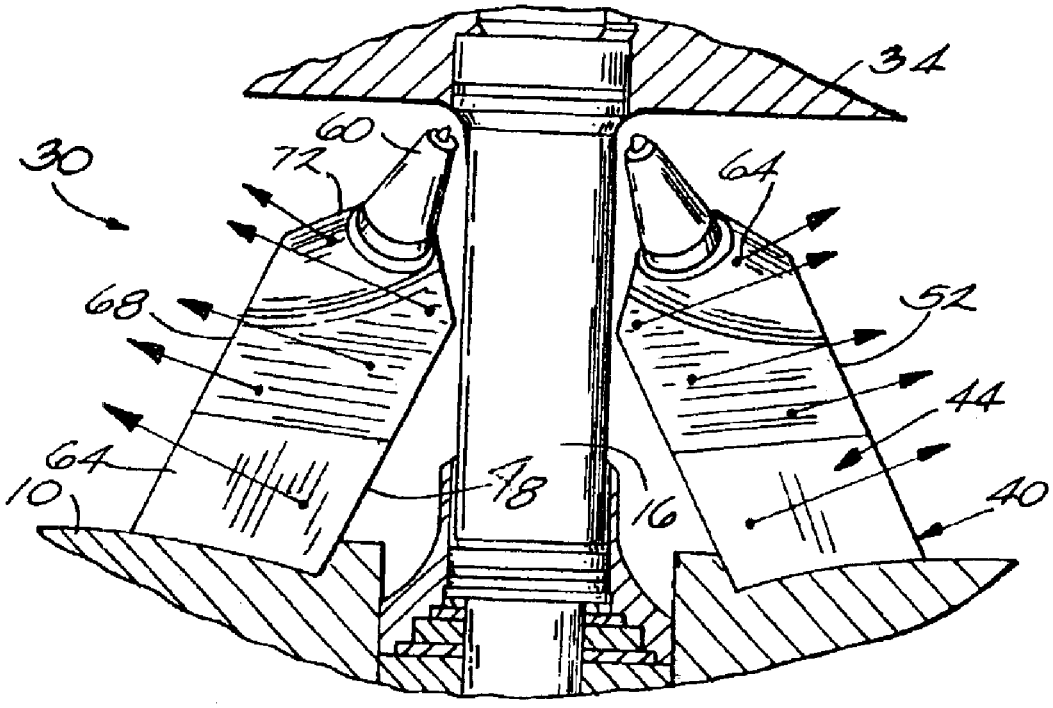
FIG. 2 is a top view of a cutting drum in accordance with the invention.

As illustrated in FIG. 2 of the drawings, this invention provides a cutting device 30 including a cutting drum 10, a motor housing 34, and a structural web 16 extending between the motor housing 34 and the cutting drum 10. The cutting device 30 also includes a structural member 40 attached to the cutting drum 10 adjacent the web 16. More particularly, two structural members 40, one on either side of the web 16, are shown.

The structural member 40 has a structural surface 44 including an edge 48 adjacent the web 16 and an edge 52 away from the web 16. The surface 44 is inclined away from the web 16 by having the edge 48 adjacent the web 16 forward in the cutting direction of the edge 44 away from the web 16. In the preferred embodiment, the structural member is a bit mechanism including a bit 60, and the structural member 40 houses the bit 60. More particularly, the structural member 44 includes a bit holder pedestal 64, a bit holder 68, and a bit sleeve 72 held by the bit holder 68. The bit sleeve 72 receives the bit 60. The surface 44 can be on the bit holder 68, on the bit sleeve 72, on the bit holder pedestal 64, or by any combination of the above.

In other embodiments, the structural member can be provided by welding a deflector plate (not shown) on the cutting drums.

What is claimed is:

1. A cutting device including a cutting drum that rotates in a cutting direction and that does not include a ripper chain, a motor housing, a structural power transmission web extending between said motor housing and said cutting drum, and a structural member attached to said cutting drum adjacent said web, said structural member having a structural surface including an edge most adjacent said web and an edge away from said web, said surface being inclined away from said web by having said edge most adjacent said web forward in the cutting direction of said edge away from said web.

2. A cutting drum in accordance with claim 1 wherein said structural member is a bit mechanism including a bit, and wherein said structural member houses said bit.

* * * * *